US006559807B2

(12) United States Patent
Koslover

(10) Patent No.: US 6,559,807 B2
(45) Date of Patent: May 6, 2003

(54) COMPACT, LIGHTWEIGHT, STEERABLE, HIGH-POWER MICROWAVE ANTENNA

(75) Inventor: Robert A. Koslover, Tustin, CA (US)

(73) Assignee: Scientific Applications & Research Associates, Inc., Huntington Beach, CA (US)

( * ) Notice: Subject to any disclaimer, the term of this patent is extended or adjusted under 35 U.S.C. 154(b) by 24 days.

(21) Appl. No.: 09/915,800

(22) Filed: Jul. 26, 2001

(65) Prior Publication Data

US 2002/0011963 A1 Jan. 31, 2002

Related U.S. Application Data

(60) Provisional application No. 60/220,930, filed on Jul. 26, 2000.

(51) Int. Cl.[7] ..... H01Q 13/00

(52) U.S. Cl. ..... 343/781 P; 343/713; 343/781 R

(58) Field of Search ..... 343/713, 772, 343/776, 779, 786, 781 P, 781 R, 915

(56) References Cited

U.S. PATENT DOCUMENTS 5,455,589 A * 10/1995 Huguenin et al. ..... 342/175
5,489,818 A * 2/1996 Naff et al. ..... 315/39
5,579,021 A * 11/1996 Lee ..... 343/779
6,014,108 A * 1/2000 Lynch et al. ..... 343/753
6,343,534 B1 * 2/2002 Khanna et al. ..... 102/402

* cited by examiner

*Primary Examiner*—Don Wong
*Assistant Examiner*—Shih-Chao Chen
(74) *Attorney, Agent, or Firm*—John J. Murphey

(57) ABSTRACT

A compact, lightweight, steerable, high-power, microwave weapon including a self-powered, steerable vehicle having at least one exterior antenna support surface, a self-powered, microwave radiation source mounted in the vehicle and including a waveguide to connect the power source to the exterior surface, a feed horn, extending from the waveguide means, including a window transparent to microwave energy for receiving and radiating a pulsed, high-energy microwave radiation beam, a transreflector fixedly mounted on the exterior surface arranged spaced-apart and above the feed horn and having a concave surface facing the feed horn window and formed of a plurality of electrical conductors held in parallel order in a frame, and a twistreflector pivotally mounted opposite and spaced-apart from the concave surface of the transreflector and adapted to receive microwave energy reflected to it from the concave surface of the transreflector and to rotate the polarization by 90° and reflect the microwave energy back to the transreflector for passing through the transreflector and forming a narrow, pencil-like beam of high-energy radiation in polarized form extending outward from the convex surface of the transreflector.

20 Claims, 15 Drawing Sheets

COMPACT, LIGHTWEIGHT, STEERABLE, HIGH-POWER MICROWAVE ANTENNA

This application claims the benefit of U.S. Provisional Application No. 60/220,930, filed on Jul. 26, 2000.

BACKGROUND OF THE INVENTION

1. Field of the Invention

This invention pertains to the field of microwave technology. More particularly, the invention pertains to a unique microwave antenna in combination with other power-generation equipment to achieve an extremely high-power, steerable, microwave cannon mountable on a vehicle for rapid deployment and operation to neutralize electrical circuitry in targets.

2. Description of the Prior Art

Electrical radiation antennas exist that broadcast a variety of low-powered signals in broad, narrow and directional beams. These low-power antennas use coaxial cable to transmit the energy from the radiation source to the antenna. In contrast, large, powerful radiation antennas have been used for radar and other operations but, when operated at power levels of 100 MW or above, their direction is frozen because of the need for heavy, rigid waveguides, maintained under high vacuum, to transmit the energy from the power source to the antenna. For those reasons, a highly maneuverable, high power, radiation antenna does not exist.

It has been determined that a high-peak power microwave transmission, on the order of more than 100 megawatts (MW) of energy, confined to a very tight beam ("pencil beam" G~30 dB) using an L-band antenna, lightweight (less than 250 kg) and compact enough to be deployed on a land vehicle or air platform, may find wide use in intercepting a target and degrading or neutralizing the electronic control monitoring systems and directional control systems in such targets as flying missiles and piloted aircraft as a means of rendering them ineffective without injuring human life. In other situations, civil authorities may find use for the device to neutralize the electrical system and computer-driven controls of an automobile or other motor vehicle thereby eliminating the need for extended car chase situations by police authorities that often result in destruction of property and severe injury or death to participants and members of the public.

SUMMARY OF THE INVENTION

This invention is a compact, lightweight, steerable, high-power microwave cannon using a unique antenna for utilization in combination with a vehicle having self-propelled motor means and a power source for providing high-power, microwave energy to the antenna system. The antenna is carried on a surface of the vehicle along with a feed mechanism where the antennas are capable of movement into a folded storage configuration for rapid transport and expansion into an upright, useful configuration for providing the pencil-thin beam of high-energy microwave radiation.

The antenna generally comprises a microwave feed horn, held under high vacuum, for transmitting the microwave energy from the power source to the antenna system. A transreflector, that includes a plurality of spaced-apart conductors arranged in parallel formation inside a frame and formed into a relatively thin concave/convex surface in a parabolic curve, is hingedly mounted on an exposed surface of the vehicle. Preferably, the antenna is capable of moving from a storage position, generally parallel to the earth's surface, to an upright position for receiving a large amount of microwave energy from the feed horn onto its concave surface.

A twistreflector is also provided in spaced-apart arrangement with the transreflector and arranged opposite and spaced-apart from the concave surface, thereof for receiving the reflected energy from said concave surface, rotating its polarization by 90° and reflecting it backward toward the transreflector. That reflected energy, because it's polarization has been rotated 90° thereafter passes through the transreflector and continues outbound from the convex surface thereof in the form of a high-power, narrow-angle beam of polarized microwave energy beam for intercepting a moving or stationary target and utilizing the microwave energy to neutralize electrical impulses and other electronic-based functions in the target.

The twistreflector is mounted for fold-down configuration, along with the transreflector, to a storage position generally parallel to the earth's surface. It is also able to be raised to an operable antenna position and is mounted on means for rotating the twistreflector about both horizontal and vertical axes. A useful feature of this invention is that for every angular degree of twist or rotation made in the twistreflector, the azimuth and/or elevation of the microwave beam is changed by twice that angle. For instance, a 10° twist in the twistreflector azimuth will produce a 20° change in the azmuthal direction of the beam.

The system operates at optimum condition when the pulse length is in the area of approximately 5 $\mu$s and at a repetition rate of more than 100 Hz. The beam produced according to this invention has more than a 30 dB gain in the L-band where $f_o$=1.3 GHz. The transreflector, as well as the twistreflector, each may cover an area of less than 7 $m^2$ thus providing a compact antenna having a mass less than 250 kg to be carried on the vehicle.

Coaxial cable feed systems, including power dividers, junctions, or the use of more traditional multiple array antennas, have no use in this high energy field. The cumbersome high-vacuum waveguides also are of no use in their traditional form because of the inability of these guides to be rapidly reconfigured to allow rapid movement of the antenna and its directed pencil beam. As disclosed herein, this invention will produce a high energy beam that can be directed over a quadrant of azimuth and a quadrant of elevation without significant loss of power or directionality and without physically moving anything but the highly twistable twistreflector. This invention can be designed to produce a highly-functional, low-loss beam beyond a complete azimuth quadrant of ninety degrees.

Accordingly, the main object of this invention is a lightweight, compact, highly-steerable and aimable, high-power microwave weapon using a unique antenna to produce a highly focused beam of energy for contacting a target to neutralize the electrically driven systems therein, such as found in missiles, airplanes and automobiles, accompanied by a low impact on human life. Other objects of the invention include a means of propagating high-powered microwave energy in a controllable fashion quickly and without the use of traditional large and cumbersome vacuum waveguides, a means of quickly applying a high-energy pulsed microwave energy beam against a moving target to neutralize its electrical control systems without simultaneously exposing the pilot or other human cargo to unhealthy radiation. Further, an object is to provide a microwave antenna system that is foldable into a low volume storage configuration and rapidly expandable to a compact operable configuration for immediate use against a target.

These and other objects of the invention will become more clear when one reads the following specification, taken together with the drawings that are attached hereto. The scope of protection sought by the inventor may be gleaned from a fair reading of the claims that conclude the specification.

DESCRIPTION OF THE PREFERRED EMBODIMENTS

Figure 1:
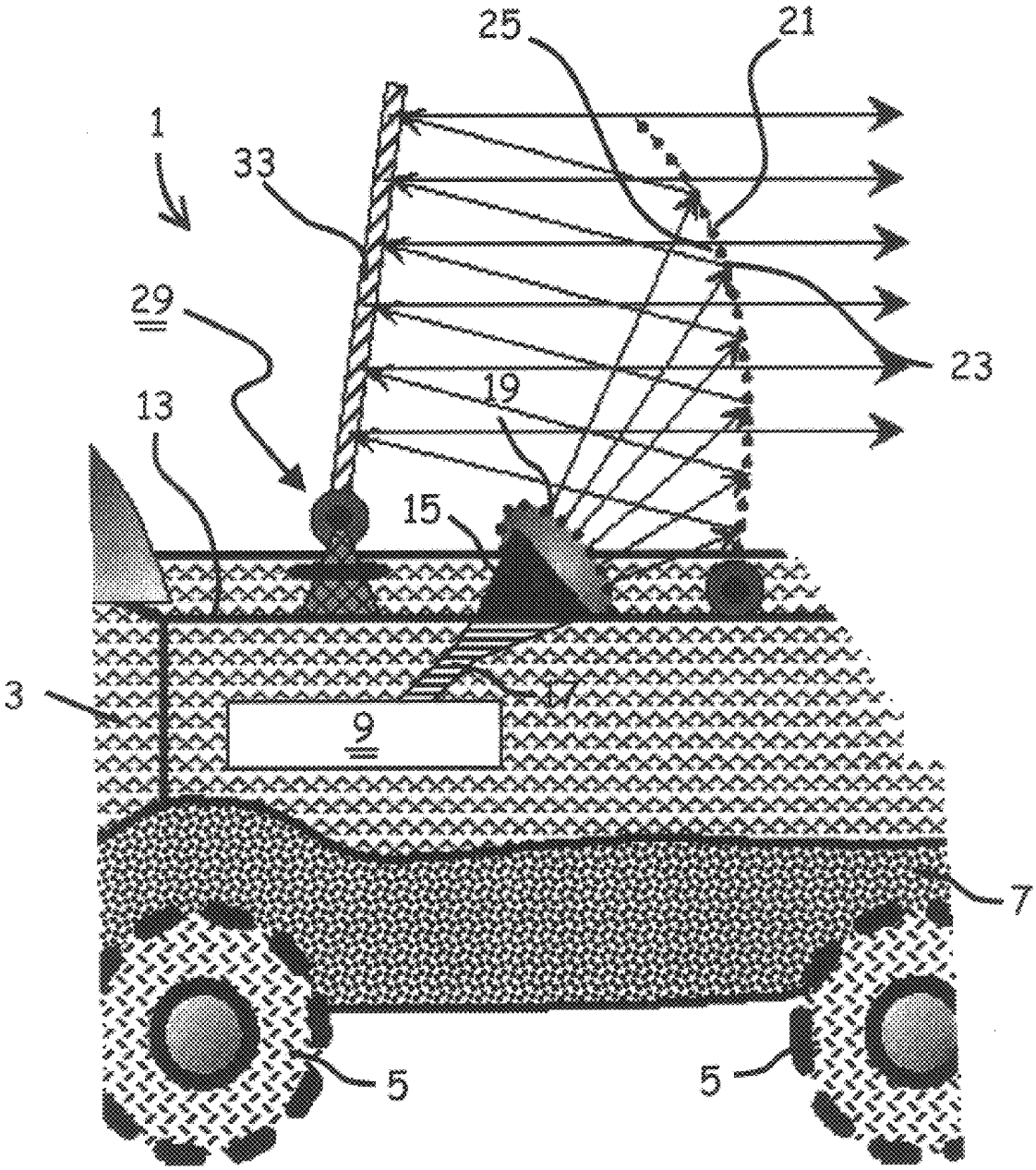
FIG. 1 is a schematic view of the overall invention showing the relative positions of the different components and an indication of how the radiation emanates from the feed horn through its contact with the transreflector and the twistreflector to pass outward through the transreflector as a beam of polarized energy.

Turning now to the drawings wherein elements are identified by numbers and like elements are identified with like numbers throughout the 15 figures, the weapon 1 is shown in schematic form in FIG. 1 to comprise a steerable, motor-driven vehicle 3 supported on a plurality of rotatable tires 5 and including a chassis 7 that houses a microwave power source 9, said vehicle 3 adapted for rapid movement over the ground.

In general, microwave source 9 is produced by a combination of a prime mover, such as an internal combustion or jet engine, that feeds to a pulse forming network or Marx bank, that, in turn, drives a high power microwave (HPM) generator, such as s super-reltron, relativistic-magnetron, virtual cathode oscillator, or relativistic Klystron, to produce the microwave radiation for channeling through the waveguide to the feed horn. These machines are found in the prior art and will not be further discussed herein. Motor-driven vehicle 3 also includes a heavier-than-air vehicle such as a helicopter or wing-supported airplane such as the four-motored configurations that are in the general shape of a Boeing 747 and the DC-10. Vehicle 3 contains an antenna support surface 13 on which is mounted a feed horn 15. Feed horn 15 is generally mounted immobile and is connected to microwave power source 9 by a thick-walled waveguide 17 maintained under high vacuum and containing an window-type outlet 19 aimed in an upward direction.

A transreflector 21 is mounted in an upright, operable, position on support surface 13 and has a general parabolic overall shape, thus forming a convex surface 23 and an opposite concave surface 25, said concave surface 25 facing in the opposite direction from that of waveguide 17. Transreflector 21 is mounted through a first hinge means 29 allowing it to rotate downward into general parallel position atop antenna support surface 13.

Transreflector 21 is generally mounted in fixed position on antenna support surface 13 in spaced-apart arrangement from feed horn 15 and has its concave surface 25 facing rearward of the broadcast microwave beam and its convex surface 23 facing outward toward the target to which the microwave beam will be directed.

Figure 3:
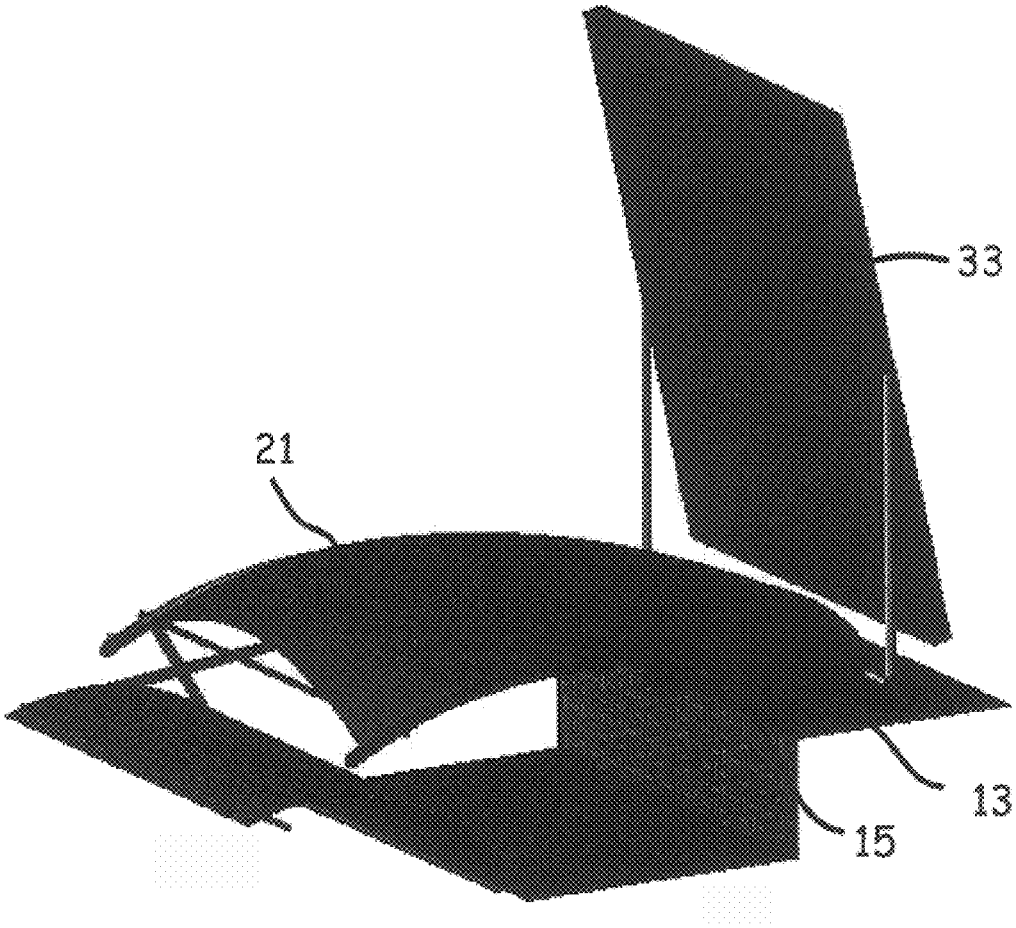
FIG. 3 is a pictorial view similar to FIG. 2, in which the transreflector is folded down into a storage position generally parallel to the earth's surface.
Figure 7:
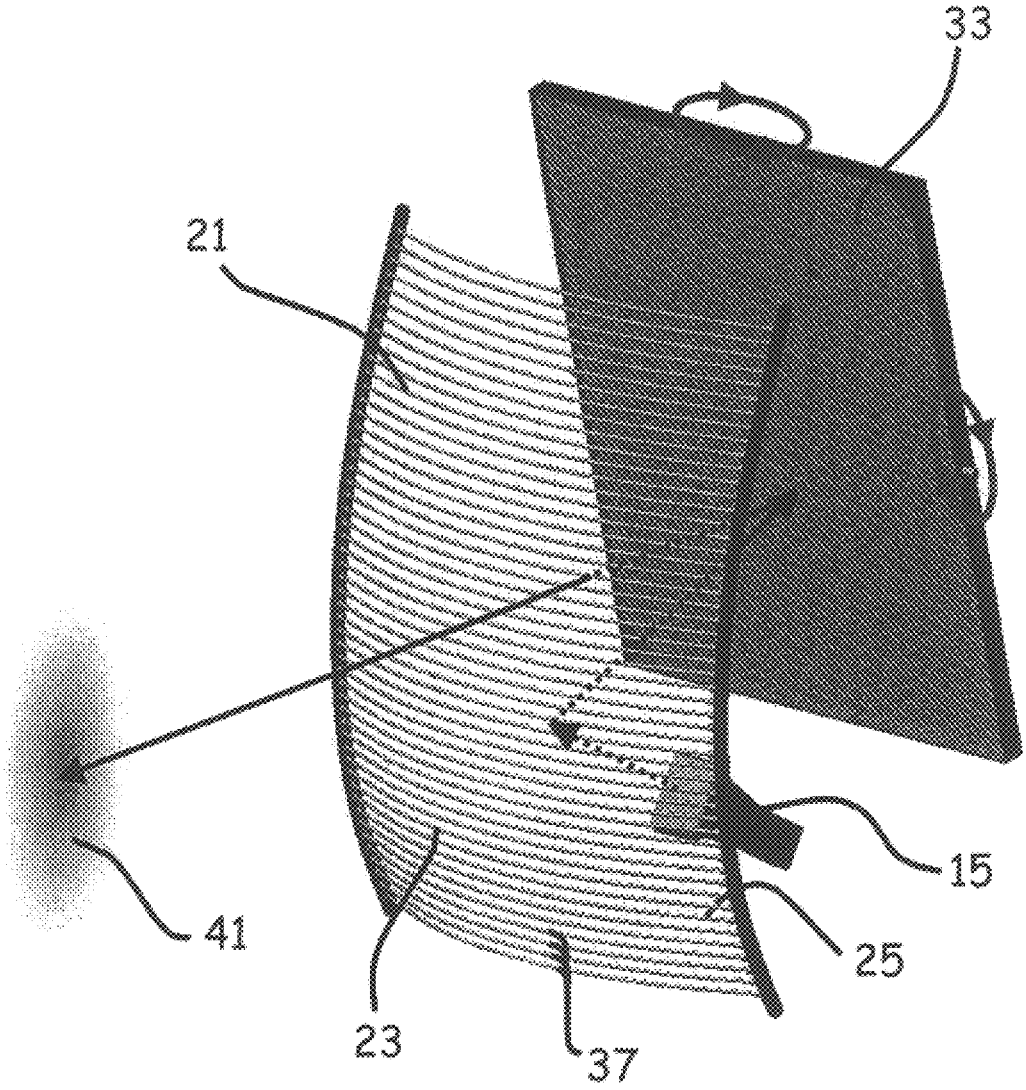
FIG. 7 is a pictorial view of the feed horn, transreflector, and twistreflector showing the path of radiation through these components to produce a high-energy, narrow beam of microwave radiation extending outward from the convex surface of the transreflector.
Figure 9:
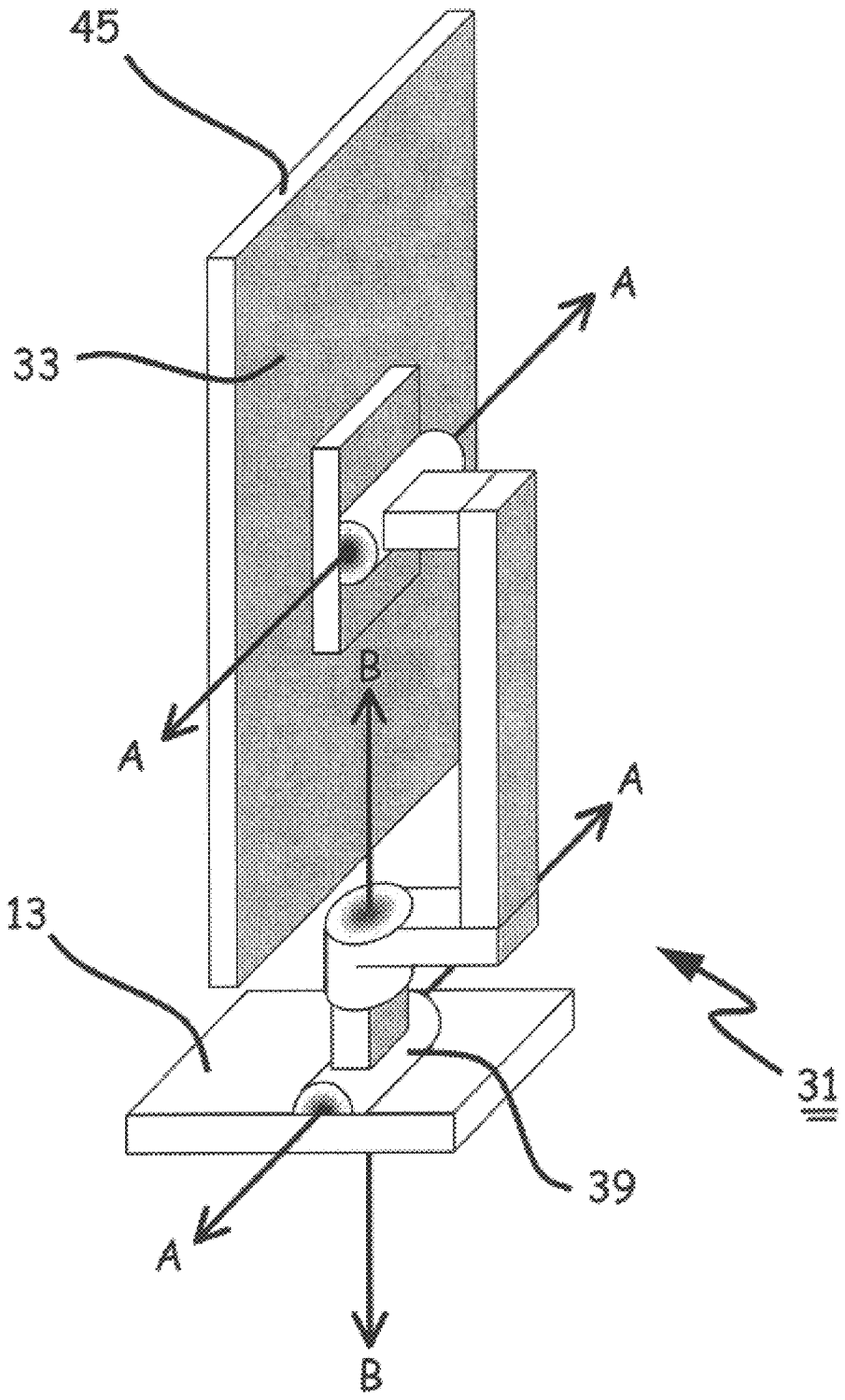
FIG. 9 is a schematic view of the various axes of rotation of the steerable means applied to the twistreflector.

A twistreflector 33 is mounted on antenna support surface 13 in a generally upright position spaced-apart from transreflector 21 and on the opposite side of feed horn 15 therefrom. As shown in FIGS. 1 and 7, radiation emanating from feed horn outlet window 19 is directed toward parabolic concave surface 25 from a low position and this arrangement allows the energy emanating from window 19 to be reflected from concave surface 25 rearward past window 19 to the reflecting surface 35 of twistreflector 33, where its polarization is rotated 90° and it is reflected backward to and through the spaced-apart conductors 37 making up transreflector 21 to proceed through said transreflector 21 and outward in a narrow beam 41 of polarized, high-energy, microwave radiation as shown in FIG. 7. Twistreflector 33 is also mounted with a second hinge means 31, that include a first pair of orthogonally arranged pivot axes, A—A and B—B for allowing the twistreflector to turn about the X and Y axes, respectively, and a second pivot 39 for allowing twistreflector 33 to be rotated downward into general parallel position atop antenna support surface 13, as shown in FIGS. 3 and 9.

Figure 8:
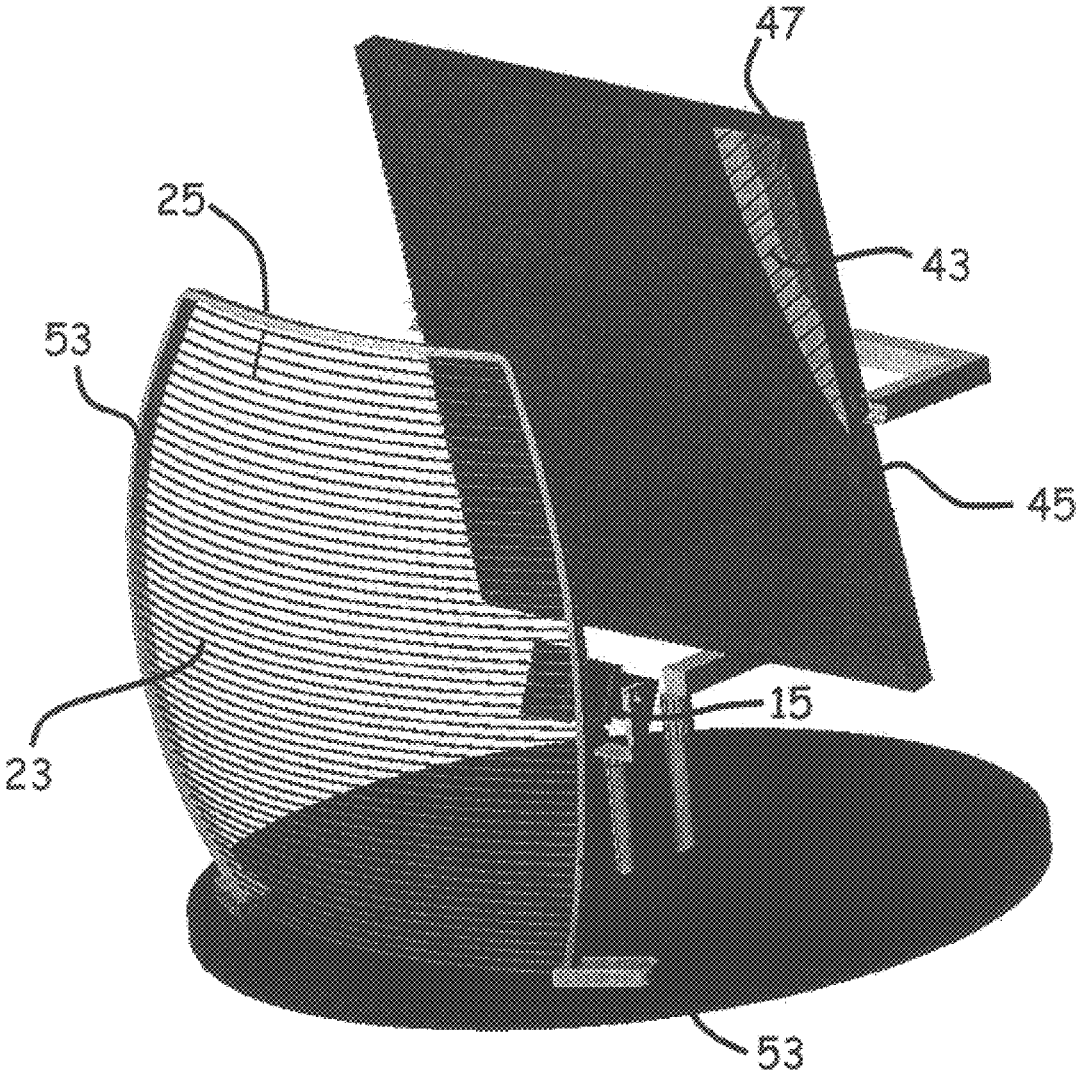
FIG. 8 is another pictorial view of the feed horn, transreflector and twistreflector showing a modification of the transreflector frame to increase the aperture efficiency of the developed antenna radiation pattern.

As shown in FIG. 8, twistreflector 33 is preferably made up of a plurality of metal wire conductors 43, arranged in spaced-apart, mutually parallel alignment and mounted in a frame 45 located in front of a microwave reflecting surface 47. It is preferred that the spacing between conductors 43 and reflecting surface 47 be on the order of one-fourth the wave length of the microwave radiation ($\lambda/4$).

Figure 2:
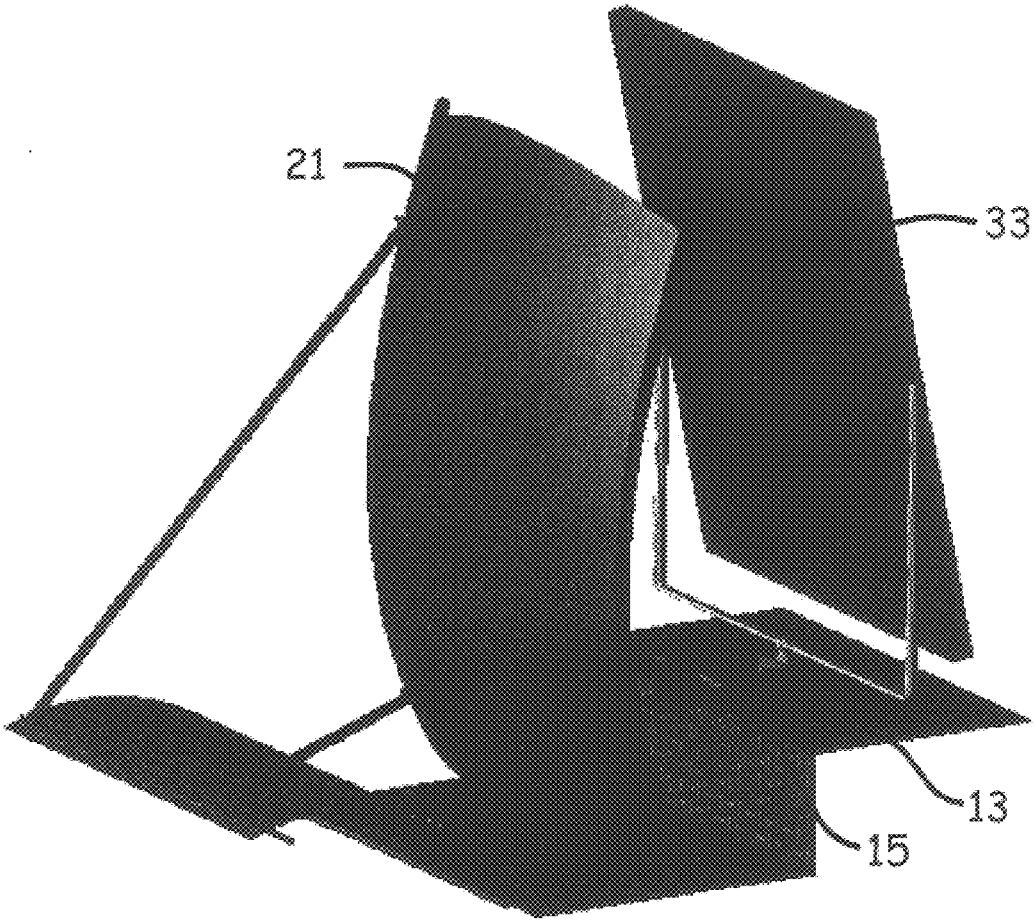
FIG. 2 is a pictorial view of the feed horn, transreflector and twistreflector in their operable position above a support surface.
Figure 4:
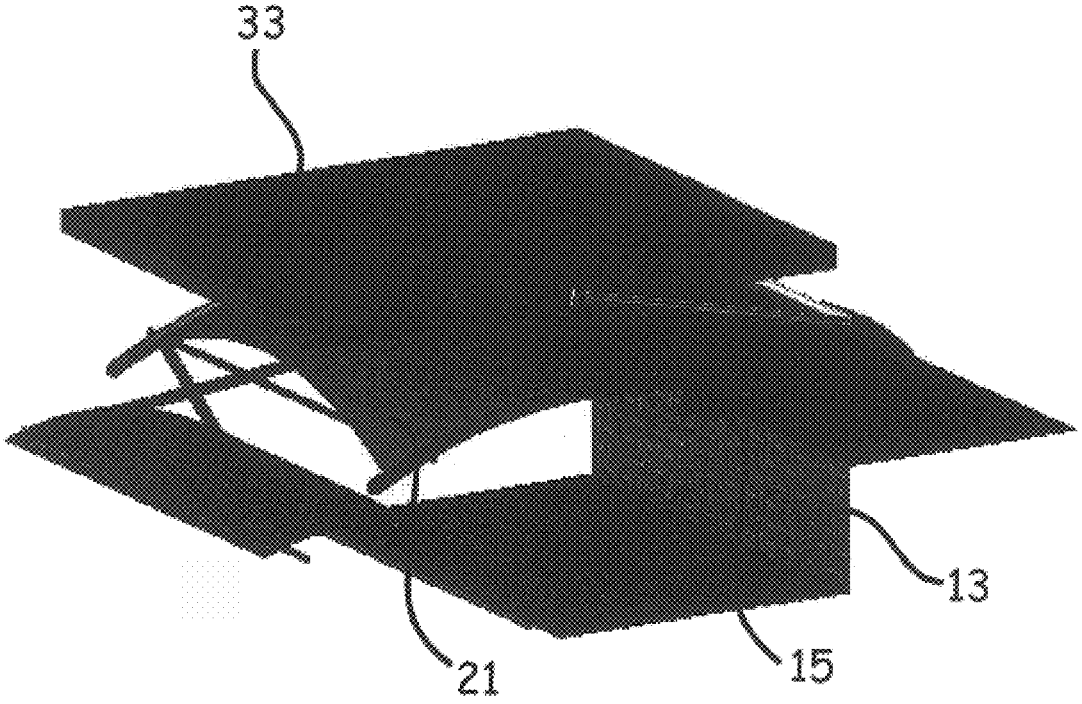
FIG. 4 is a pictorial view similar to FIGS. 2 and 3, in which the twistreflector is folded down over the transreflector into a storage position generally parallel to the earth's surface.

FIG. 2 shows feed horn 15, transreflector 21 and twistreflector 33 in operable position on antenna support surface 13. FIG. 3 shows the beginning of the storage operation whereby transreflector 21 is pivoted over and down onto antenna support surface 13. FIG. 4 shows twistreflector 33 thereafter being pivoted downward over top of transreflector 21 so that both reflectors lie in storage position generally parallel to the earth's surface.

Figure 5:
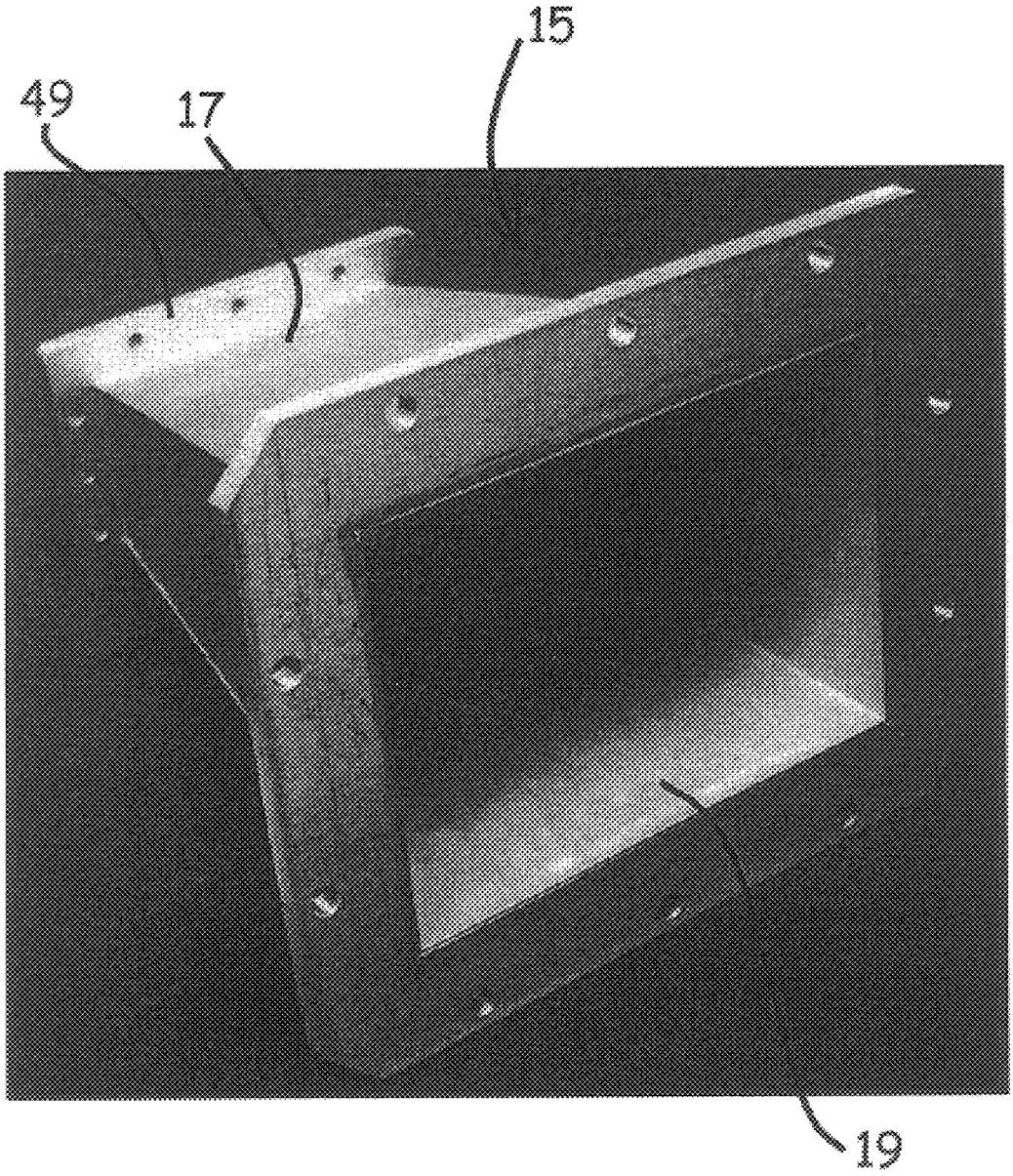
FIG. 5 is a closeup isometric view of one form of the feed horn of this invention.

FIG. 5 shows a typical example of feed horn 15 having an input end 49, the thick-walled, pyramidal-shaped waveguide body 17, and the covered outlet 19. The outlet cover (not shown) is transparent to microwave radiation and preferably in the form of an acrylic plastic such as Lucite® plate of a general thickness of one-half the radiated wave length in the plastic ($\lambda/2$) or about three inches thick when the wave length is about 23 cm (in air). It is provided to cover over the outlet and allow a high vacuum to be maintained in waveguide 17.

Figure 6:
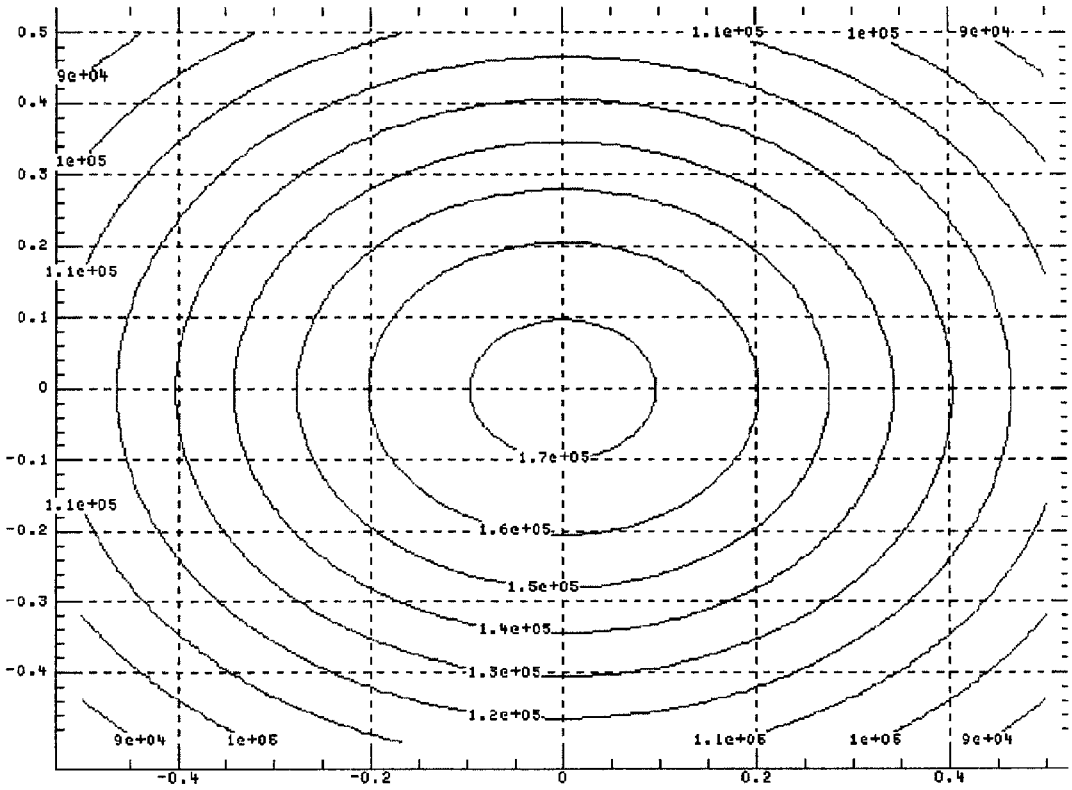
FIG. 6 is a plot of the rms electric field (v/m) issued from the feed horn showing its illumination of a planar region in the vicinity of the transflector.

FIG. 6 is a plot of the rms electric field (v/m) issued from the feed horn showing its illumination of a planar region in the vicinity of transflector 21. Tests have demonstrated a peak rms field strength of $E_{rms}$~1.7 kV/cm can be achieved at the inner ring.

FIG. 8 shows a more modern and preferred frame 53, over that shown in FIG. 7, surrounding transreflector 21 having slightly rounded side edges to increase aperture efficiency and gain of the radiation produced in beam 41.

Figure 10:
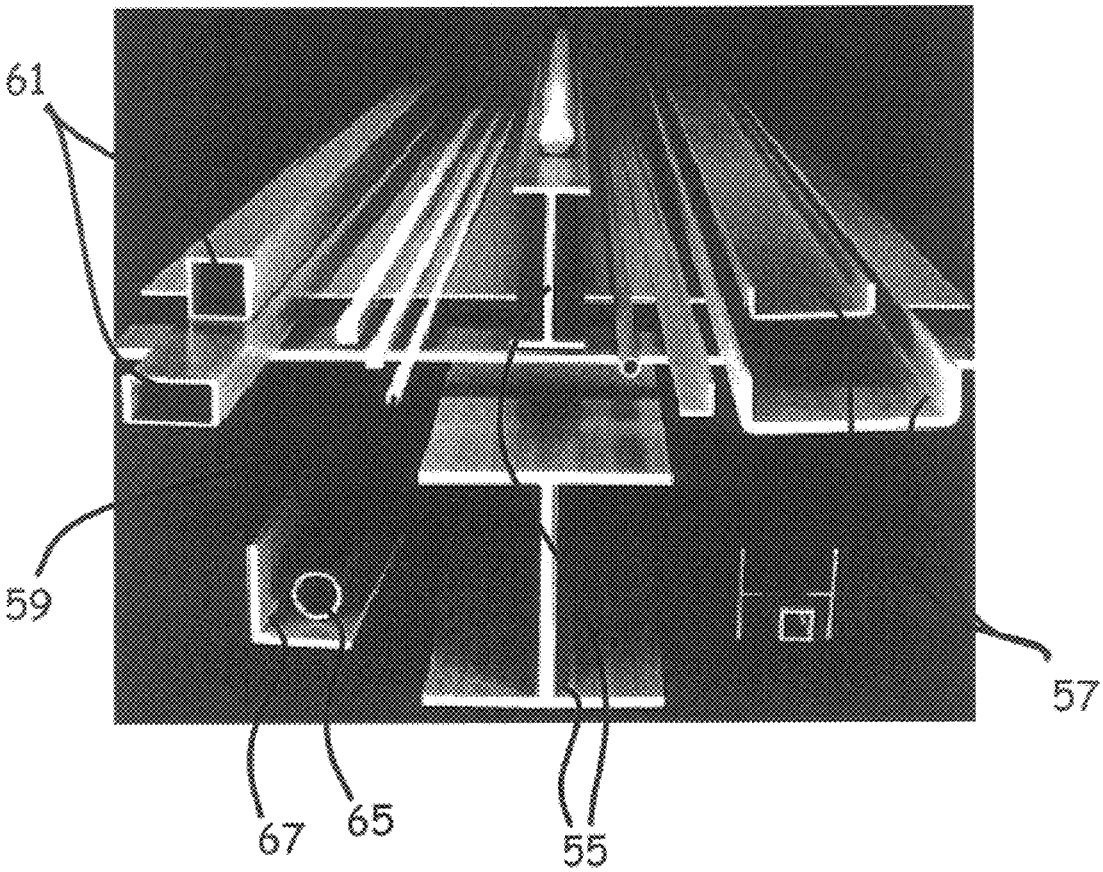
FIG. 10 is a perspective view of various configurations of construction materials useful in this invention.

FIG. 10 shows a plurality of types of materials useful in constructing transreflector 21 and twistreflector 33. As shown, thin-walled, fiber reinforced epoxy resin based construction material, such as I-beams 55, C-channels 57, solid squares 59, hollow, square pipes 61, hollow tubes 65 and L-angles 67 are all useful in this invention because they provide substantial support without interfering with the microwave radiation or the shaping of its beams.

Figure 11:
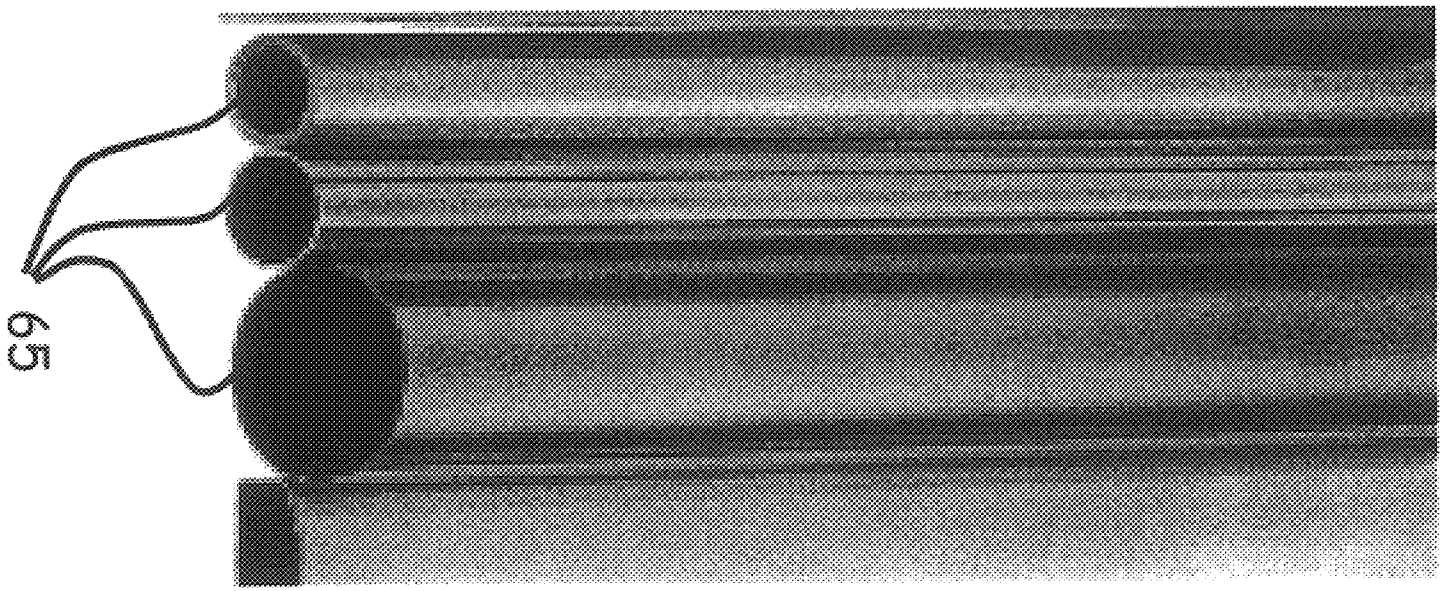
FIG. 11 is an illustrative view of various types of pipes that may be used to form the conductors useful in the transreflector of this invention.

Shown in FIG. 11 are a plurality of types of copper pipes and tubing 61 that may be used for the conductors in transreflector 21. It is preferred that transreflector 21 be made of separate pieces of 1.5 cm diameter approximately 2m long thin-walled copper, aluminum, or alloys thereof, tubing be used as conductors in transreflector 21, each tube placed parallel to the adjacent tube and spaced at 5 cm intervals in the proper paraboloidal curve. Such bending can generally be accomplished by a computer-numerically controlled bending machine normally known as a "CNC" machine. These tubes would then be individually assembled and supported on a fiberglass frame 45 (see FIG. 8) to make a lightweight, yet strong, transreflector.

Figure 12:
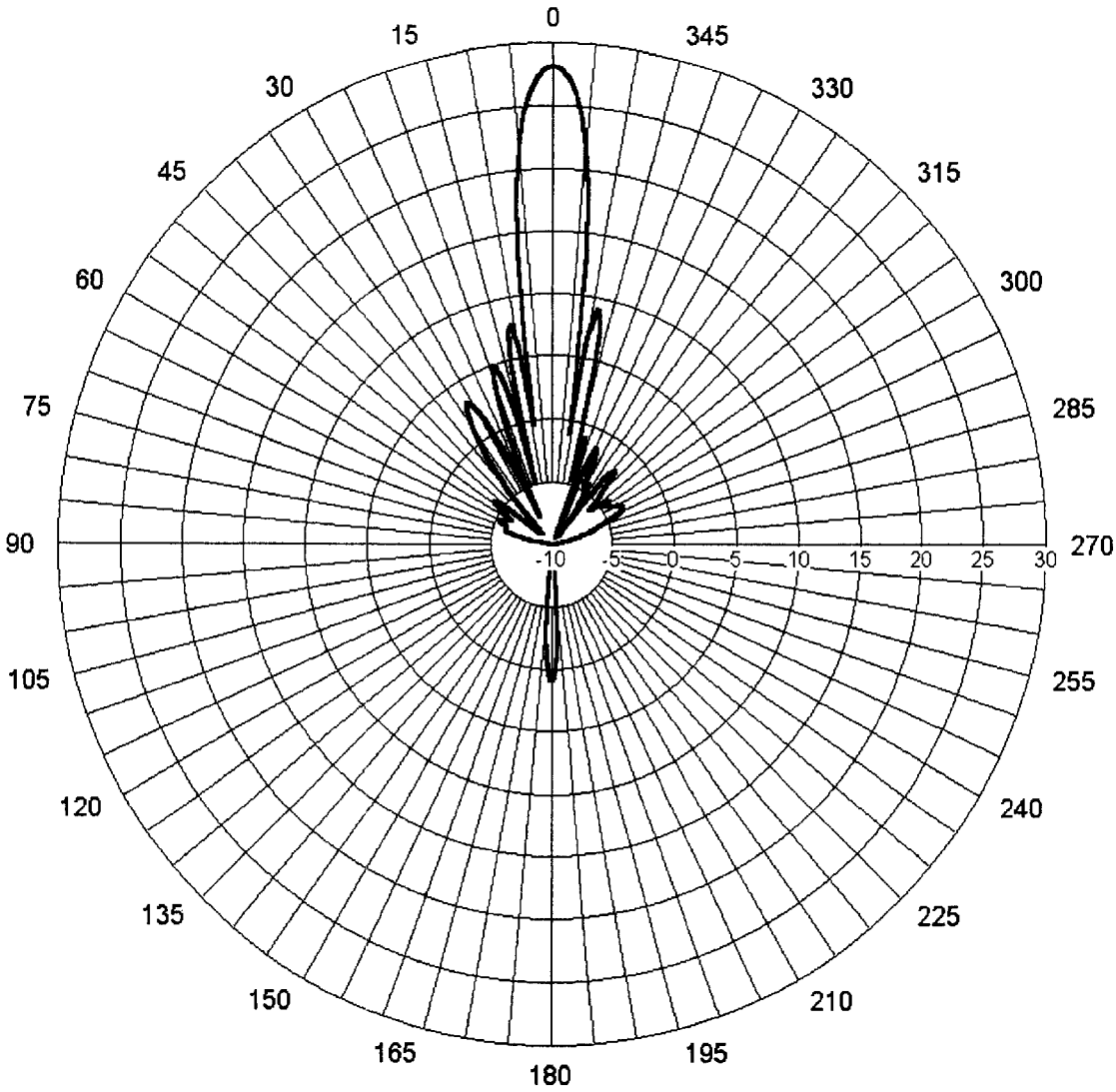
FIG. 12 is an azimuth view of the radiation from the combination of feed-horn transreflector-twistreflector combination of this invention in the straight-ahead configuration.
Figure 13:
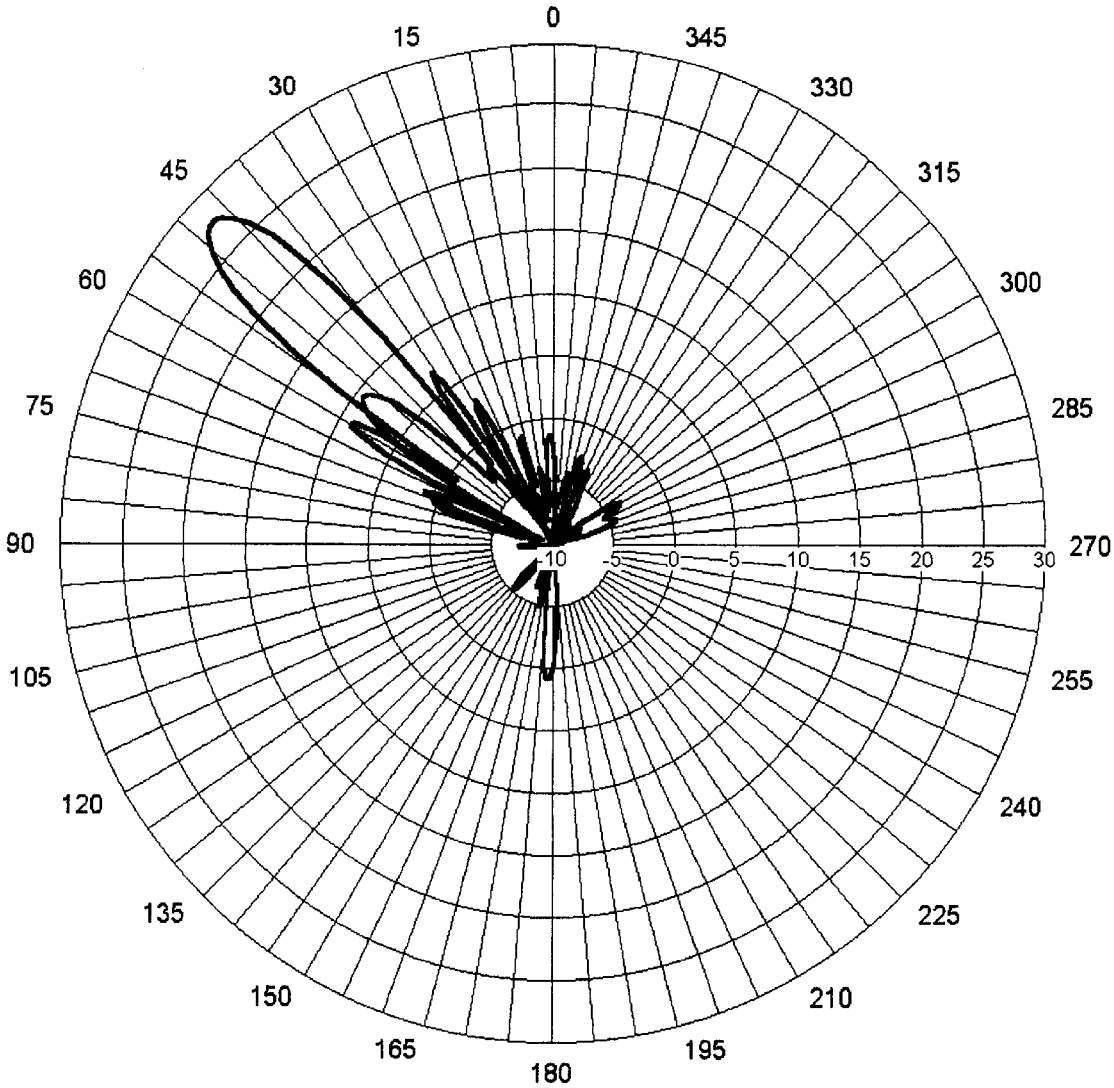
FIG. 13 is an azimuth view of the radiation from the feed horn-transreflector-twistreflector combination of this invention in a 22.50 twist to the left configuration.
Figure 14:
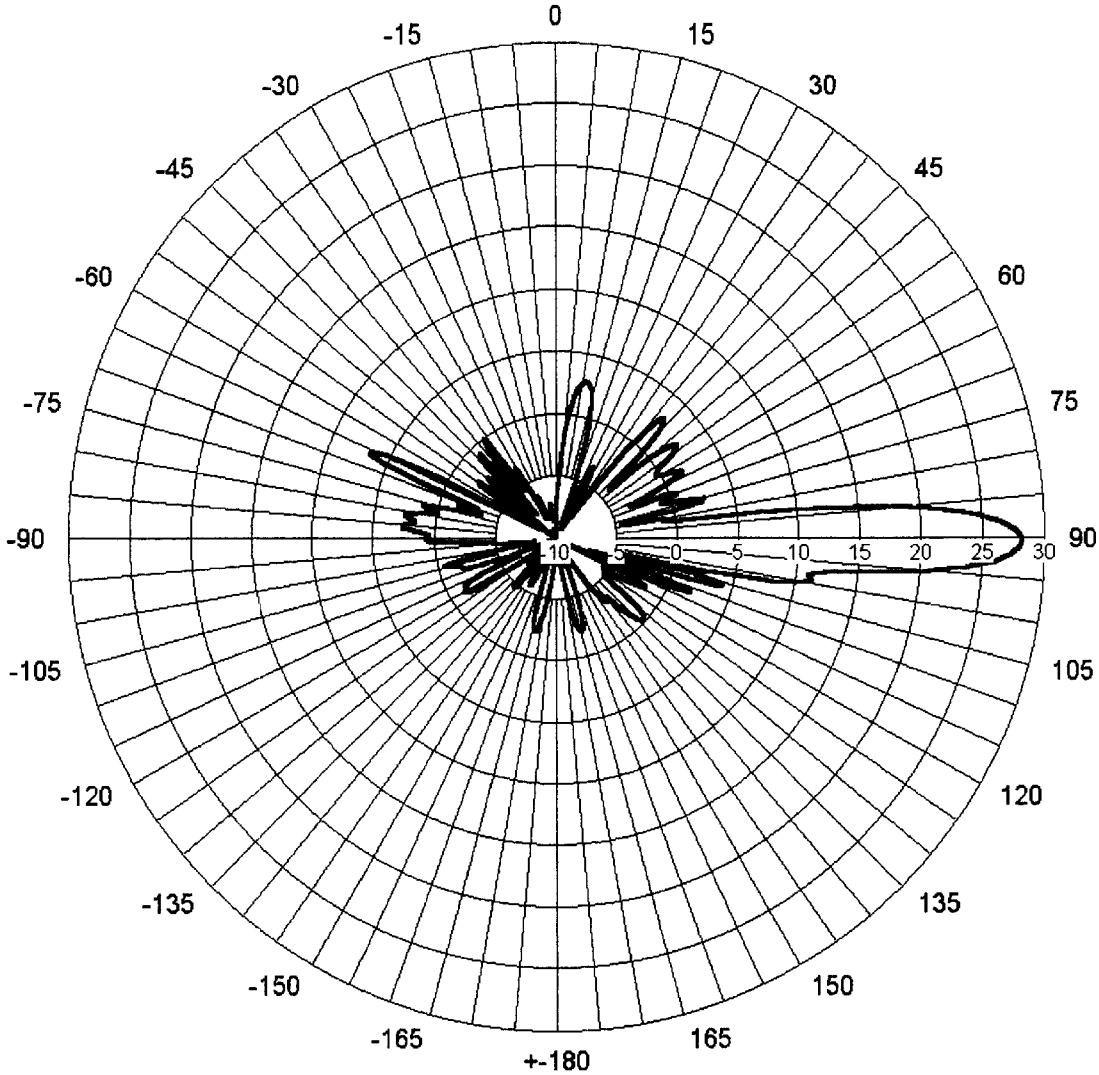
FIG. 14 is an elevation view of the radiation from the feed horn-trans-reflectortwist-reflector combination of this invention in the straight ahead configuration; and, FIG. 15 an elevation view of the radiation from the feed horn-trans-reflectortwist-reflector combination of this invention in a 12.5° upward slant elevation of the configuration.

FIGS. 12–15 show the benefits of the combination of this invention. FIG. 12 shows an azimuth chart showing the pencil beam 41 radiation in a neutral or straight ahead position of transreflector 21 and twistreflector 33. FIG. 13 shows the same azimuth chart when twistreflector 33 is rotated to the left approximately 22.50 to produce a 47° azimuth displacement of the beam to the left. FIG. 14 shows an elevation view of the same beam with twistreflector 31 to produce a beam straight ahead.

Figure 15:
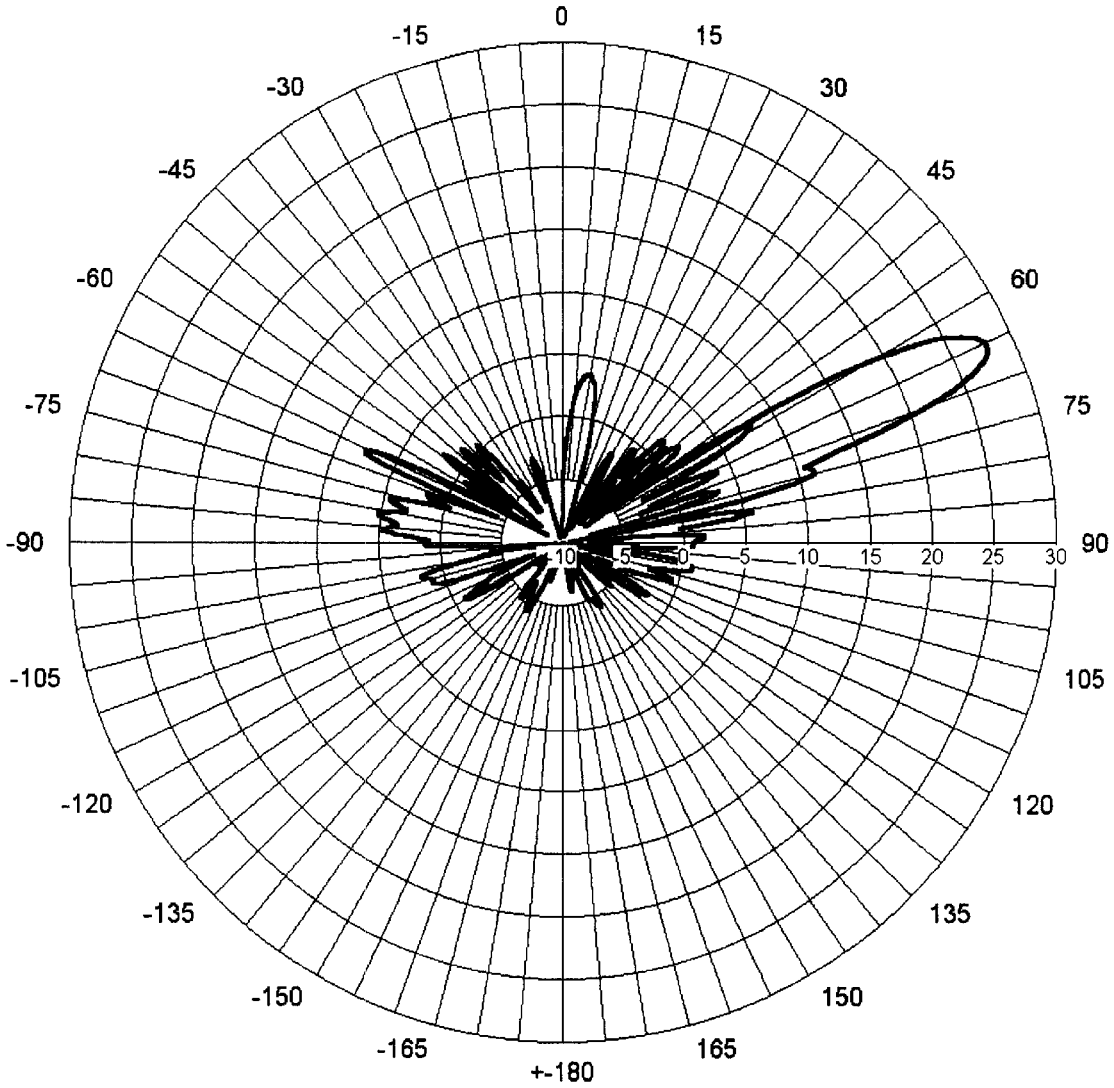
Figure 1:
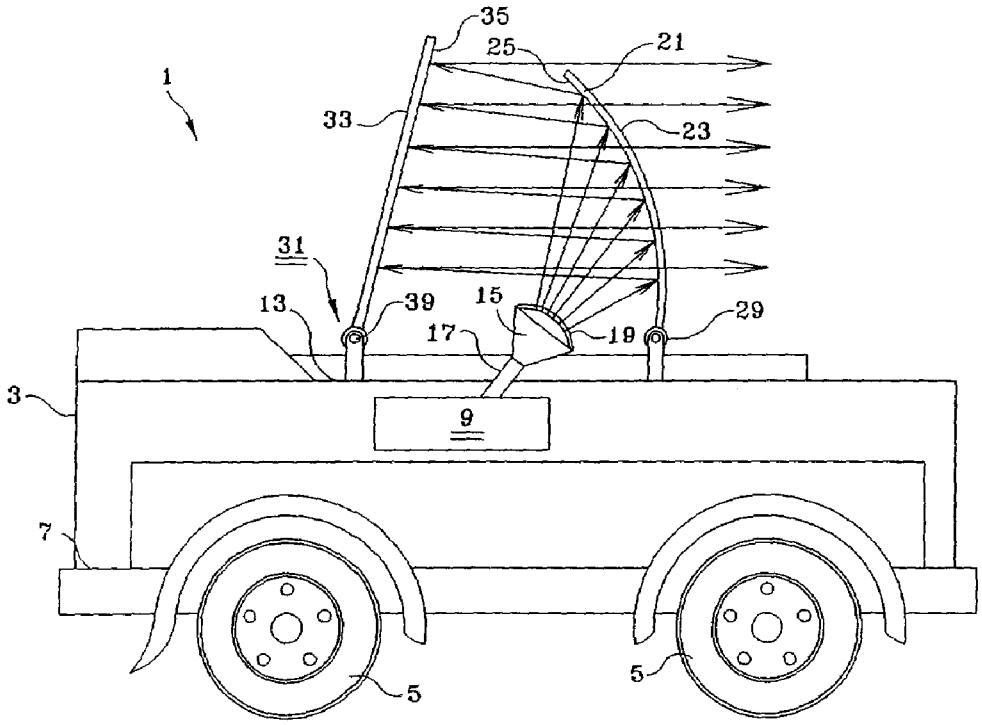
Figure 2:
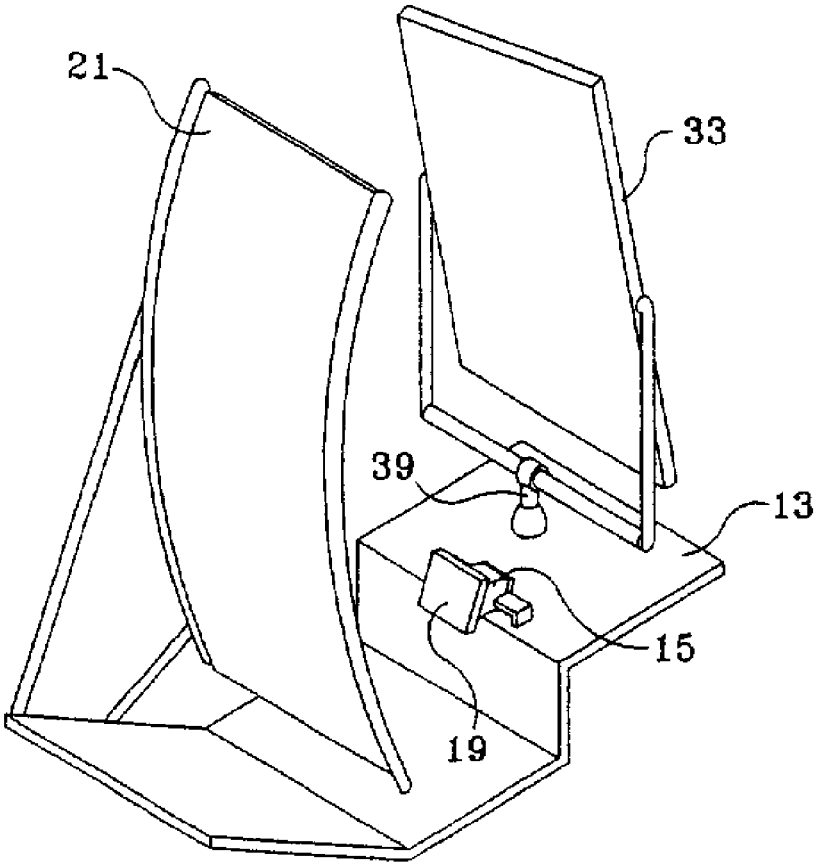
Figure 3:
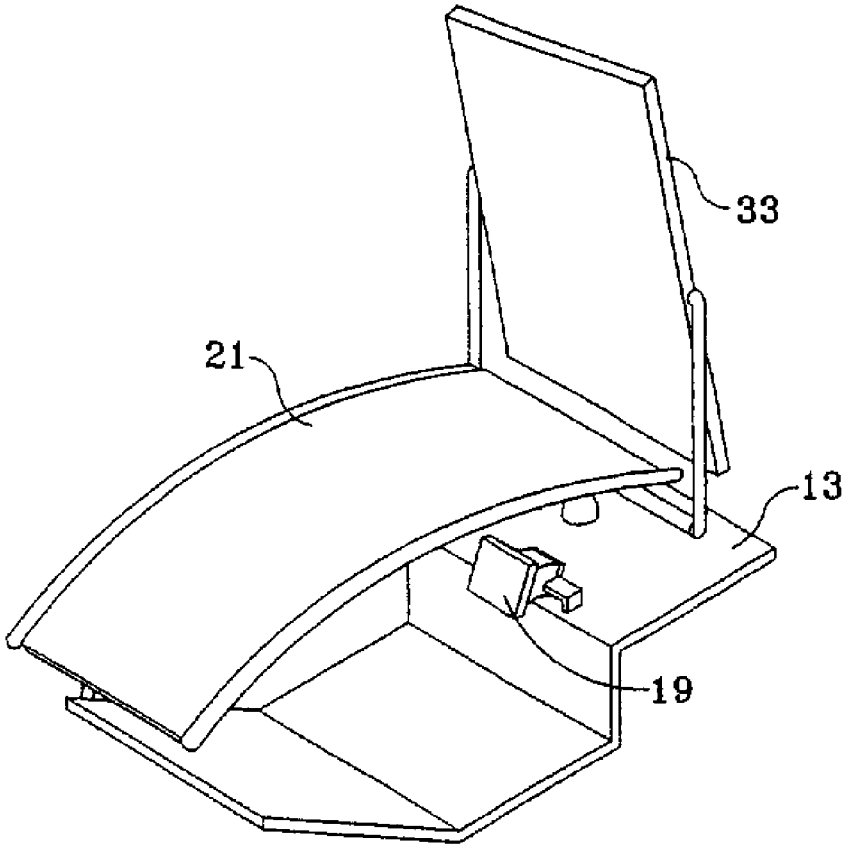
Figure 4:
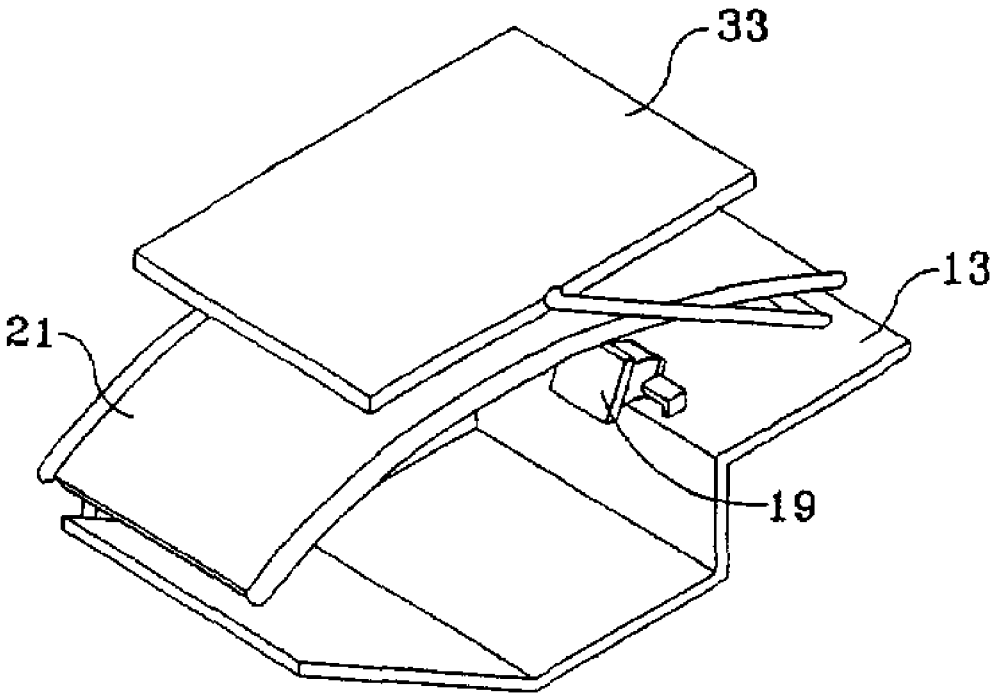
Figure 5:
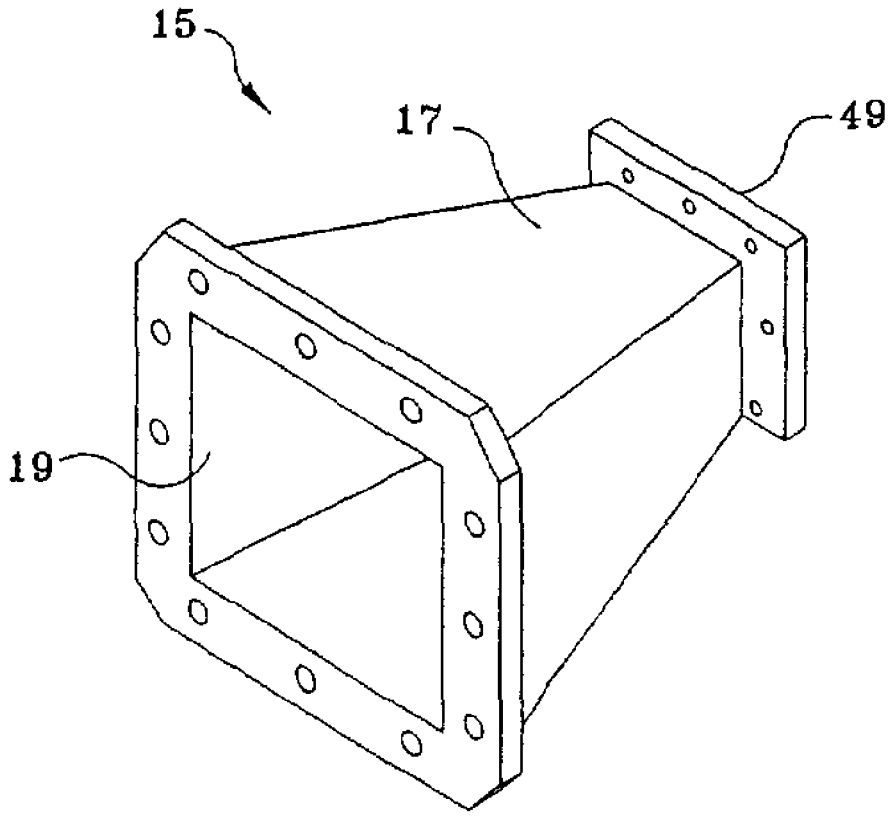
Figure 6:
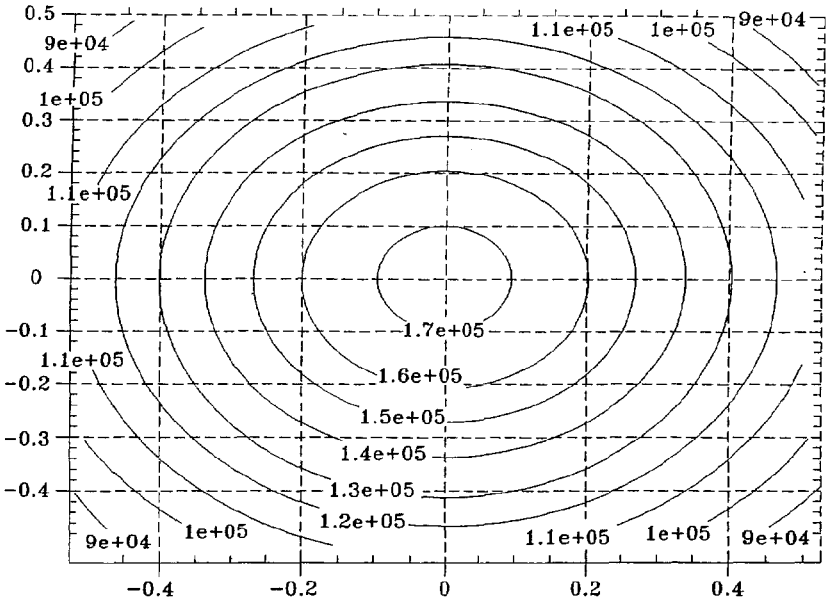
Figure 7:
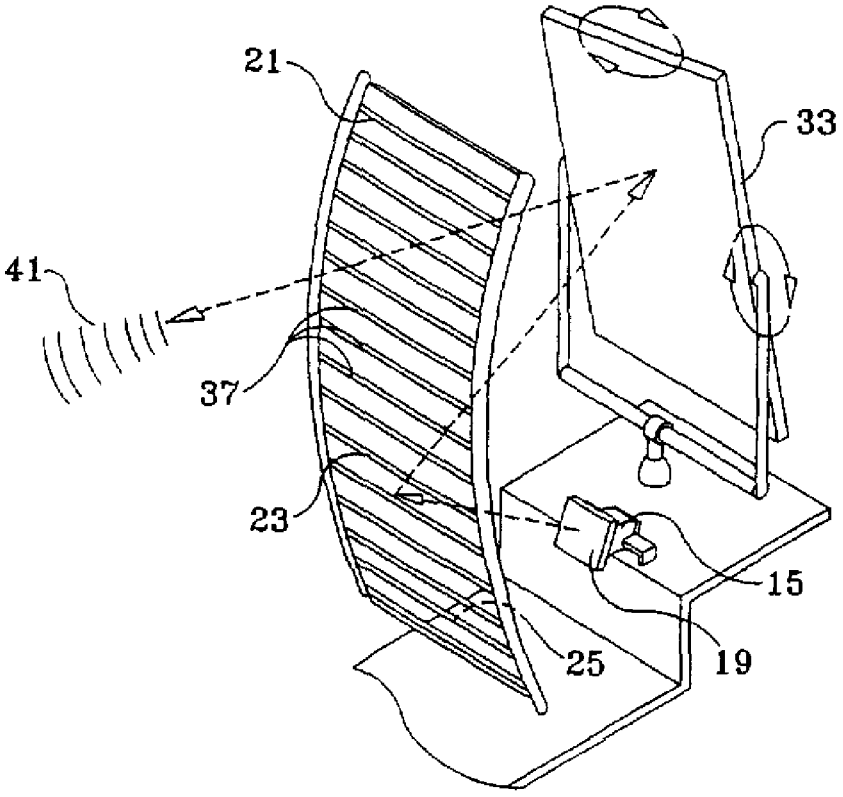
Figure 8:
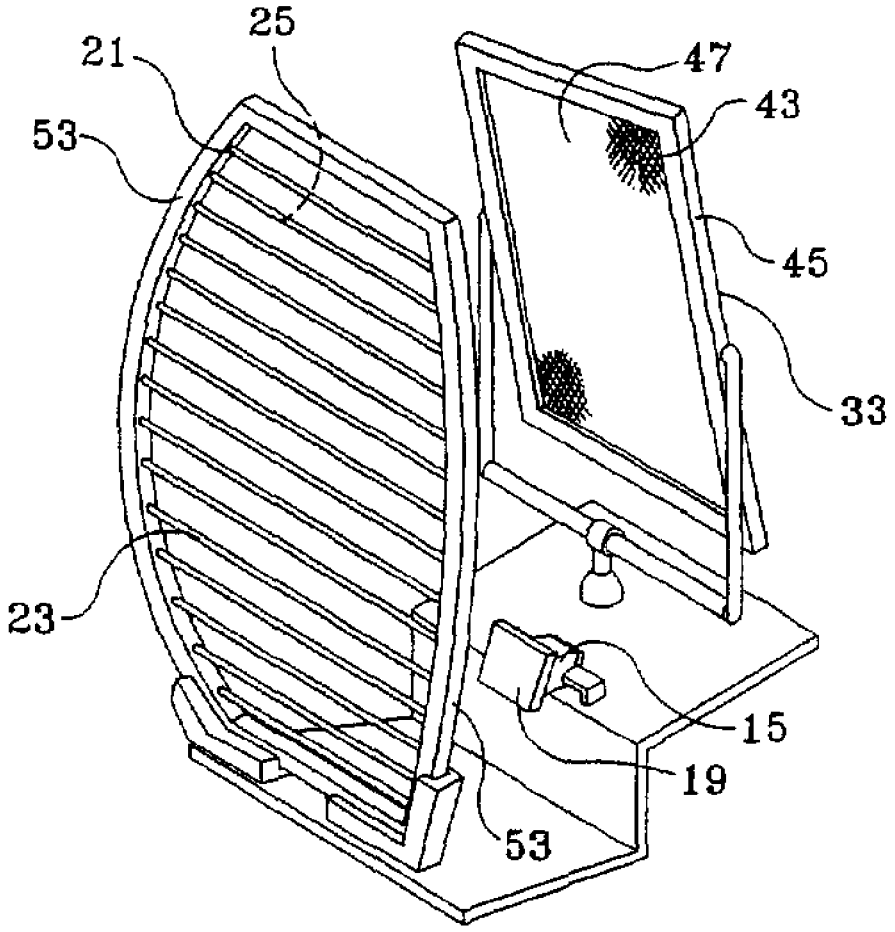
Figure 9:
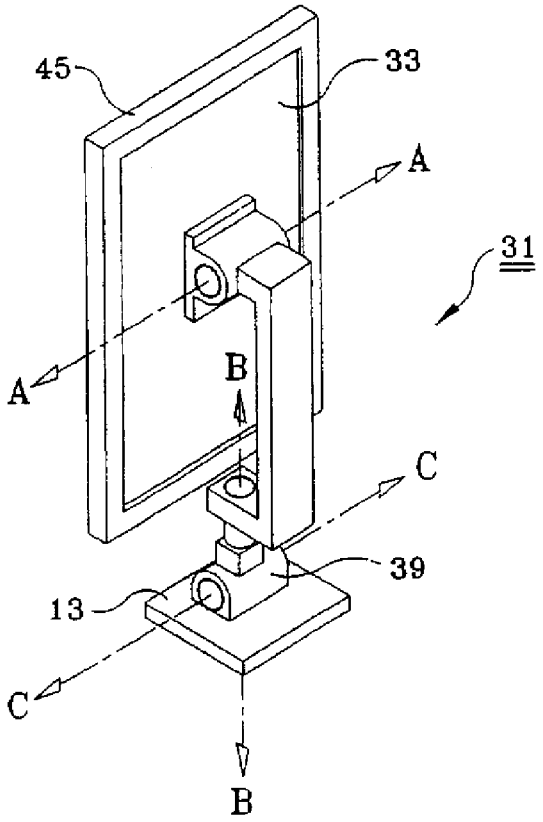
Figure 10:
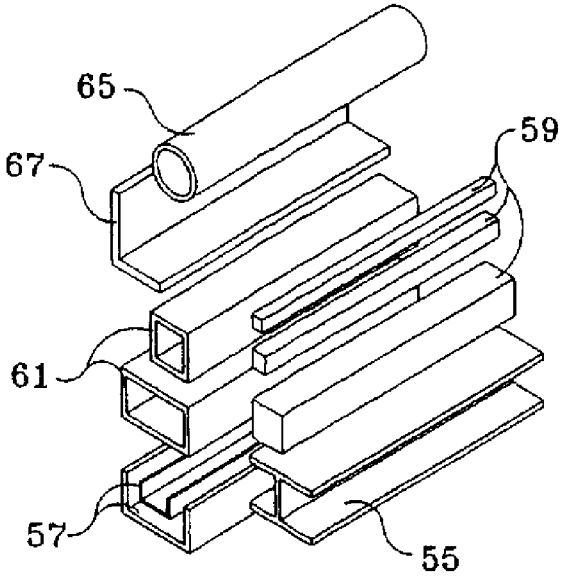
Figure 11:
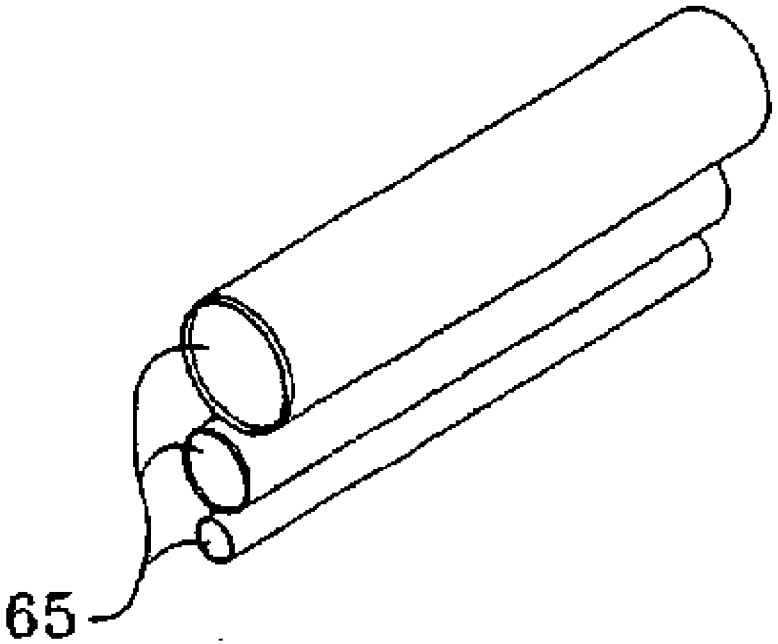
Figure 12:
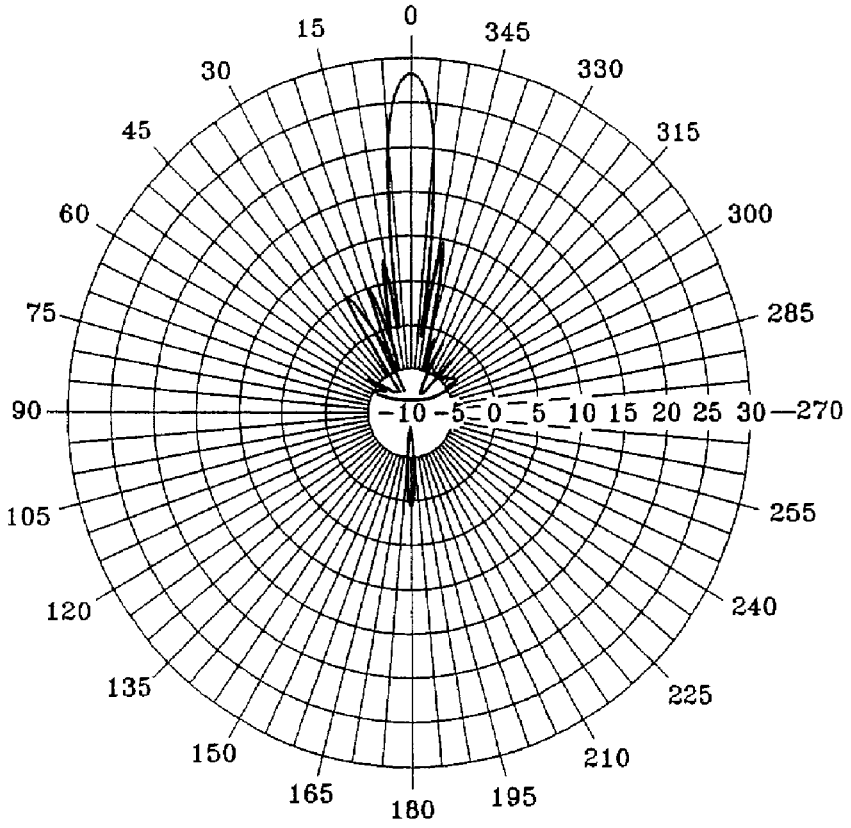
Figure 13:
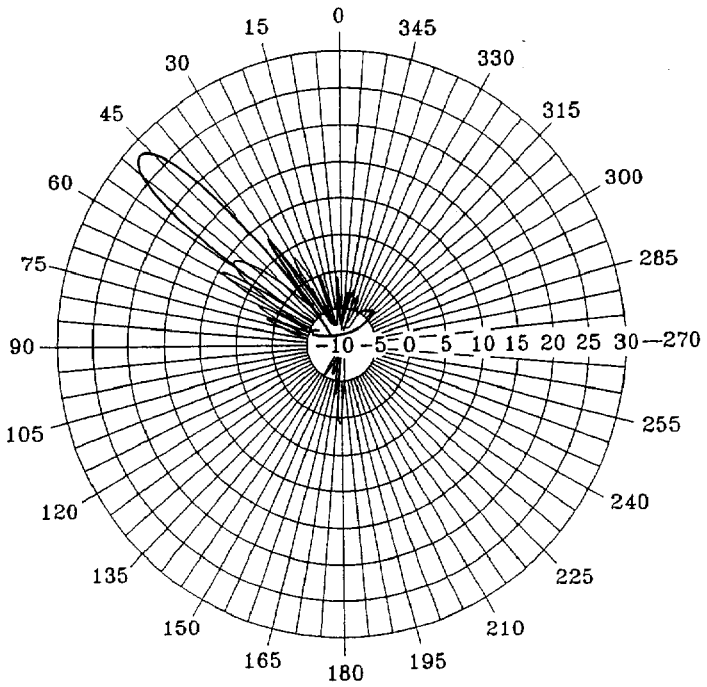
Figure 14:
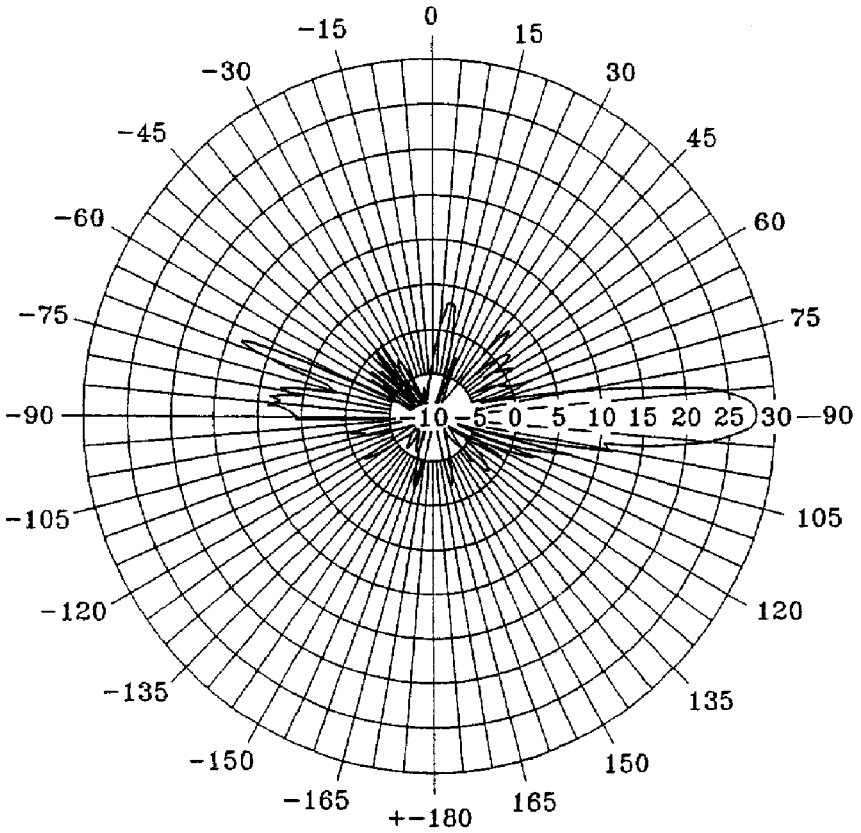
Figure 15:
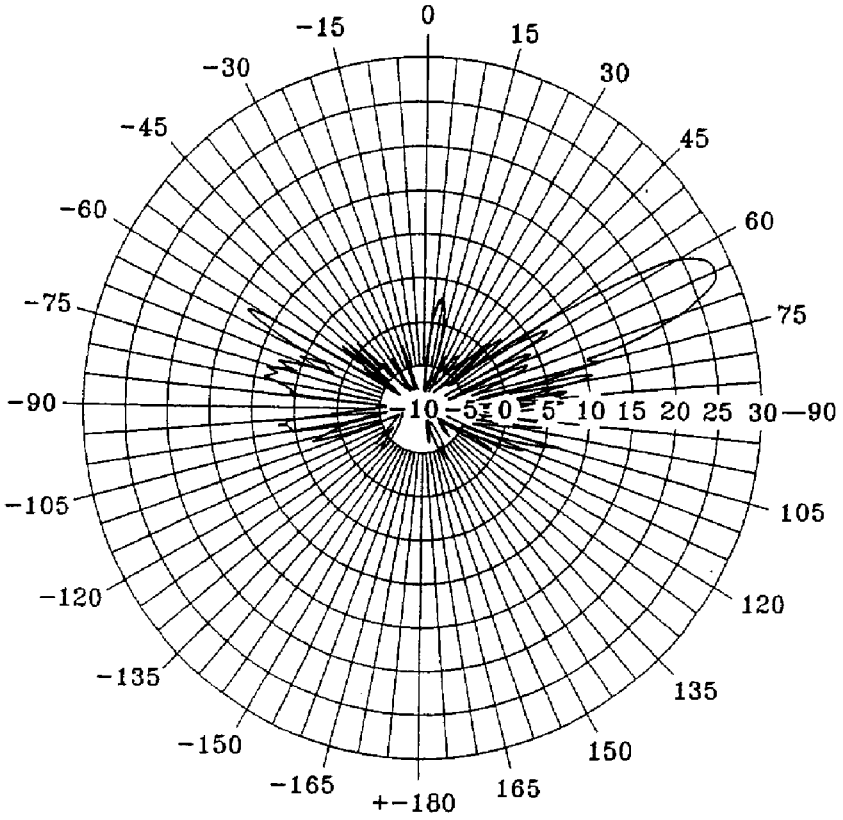

Finally, FIG. 15 shows the beam pattern radiation when the beam is elevated by pivoting twistreflector 33 upward at an angle of 12.5° to obtain an elevation of 25°, corresponding to an angle from the vertical of 90°−250=65°.

While the invention has been described with reference to a particular embodiment thereof, those skilled in the art will be able to make various modifications to the described embodiment of the invention without departing from the true spirit and scope thereof. It is intended that all combinations and elements and steps to perform substantially the same function in substantially the same way to achieve substantially the same result are within the scope of this invention.

What is claimed is:

1. A compact, lightweight, steerable, high-power, microwave weapon comprising:

(a) a self-powered, steerable vehicle having at least one exterior antenna support surface;

(b) a self-powered, microwave radiation source mounted in said vehicle and including waveguide means to connect said power source to said exterior surface;

(c) a feed horn, extending from said waveguide means, including a window transparent to microwave energy for receiving and radiating a pulsed, high-energy microwave radiation beam;

(d) a transreflector fixedly mounted on said exterior surface arranged spaced-apart and above said feed horn and having a concave surface facing said feed horn window and formed of a plurality of electrical conductors held in parallel order in a frame; and (e) a twistreflector pivotally mounted opposite and spaced-apart from said concave surface of said transreflector and adapted to receive microwave energy reflected to it from said concave surface of said transreflector and to rotate the polarization of said microwave energy and reflect said microwave energy back to said transreflector for passing through said transreflector and forming a narrow, pencil-like beam of high-energy radiation in polarized form extending outward from said convex surface of said transreflector.

2. The microwave weapon of claim 1 wherein said vehicle is supported on rotating wheels for travel over land.

3. The microwave weapon of claim 1 wherein said vehicle is a heavier-than-air device capable of traveling through the atmosphere.

4. The microwave weapon of claim 1 wherein said feed horn comprises a thick-walled waveguide maintained under high vacuum and containing an outlet aimed in an upward direction.

5. The microwave weapon of claim 1 wherein said transreflector further includes a plurality of thin-walled metal tubing mounted in parallel, spaced-apart, arrangement within a frame surrounding the perimeter thereof.

6. The microwave weapon of claim 5 wherein the metal tubing is selected from the group consisting of copper, aluminum, and alloys thereof.

7. The microwave weapon of claim 5 wherein said frame includes at least one pair of facing, spaced-apart curved side frame members.

8. The microwave weapon of claim 1 wherein said transreflector includes a first hinge means for pivotal movement thereof from an upright, operable, position into a downward, storage, position generally parallel to the earth's surface.

9. The microwave weapon of claim 1 wherein said twistreflector includes second hinge means allowing said twistreflector to pivot about a horizontal axis and a vertical axis.

10. The microwave weapon of claim 1 further including a pivot allowing said twistreflector to be folded downward into a storage position generally parallel to the earth's surface.

11. The microwave weapon of claim 1 wherein said microwave radiation is pulsed at about 100 Hz at a pulse rate of about 5 gs and a power of more than 100 megawatts.

12. A highly-compact, lightweight, steerable microwave antenna comprising, in combination:

(a) a feed horn, adapted to receive a high-energy pulsed beam of microwave energy and transmitting it outward from a terminal end thereof;

(b) a transreflector mounted apart from said feed horn and forming a concave/convex surface adapted to receive said microwave radiation from said feed horn on its concave surface and reflect it substantially in a single direction;

(c) a planar twistreflector pivotally mounted opposite and spaced-apart from said concave surface of said transreflector and adapted to receive said microwave radiation reflected from said concave surface of said transreflector and to rotate its polarization by 90° and reflect it backward toward said transreflector for passage therethrough to form a high-density, narrow beam of polarized microwave radiation for broadcast outward in a controllable direction from said convex surface thereof; and, (d) means associated with said twistreflector for pivoting said twistreflector about various axes for displacing said narrow beam of microwave radiation in different azimuths and elevations on demand from said convex surface of said transreflector.

13. The microwave antenna of claim 12 wherein said feed horn comprises a thick-walled waveguide maintained under high vacuum and containing an outlet aimed in an upward direction.

14. The microwave antenna of claim 12 wherein said transreflector further includes a plurality of thin-walled metal tubing mounted in parallel, spaced-apart, arrangement within a frame surrounding the perimeter thereof wherein the metal in the tubing is selected from the group consisting of copper, aluminum, and alloys thereof.

15. The microwave antenna of claim 14 wherein said frame includes at least one pair of facing, spaced-apart curved side frame members.

16. The microwave antenna of claim 12 wherein said transreflector includes a hinge for pivotal movement thereof from an upright, operable, position into a downward, storage, position generally parallel to the earth's surface.

17. The microwave antenna of claim 12 wherein said twistreflector includes pivotal means allowing said twistreflector to pivot about various axes.

18. The microwave antenna of claim 17 further including a hinge allowing said twistreflector to be folded downward into a storage position generally parallel to the earth's surface.

19. The microwave antenna of claim 12 wherein said microwave radiation is pulsed at about 100 Hz at a pulse rate of about 5 $\mu$s.

20. The microwave antenna of claim 19 wherein the power of the microwave radiation is greater than 100 megawatts.

* * * * *

UNITED STATES PATENT AND TRADEMARK OFFICE

CERTIFICATE OF CORRECTION

PATENT NO. : 6,559,807 B2
DATED : May 6, 2003
INVENTOR(S) : Robert A. Koslover

It is certified that error appears in the above-identified patent and that said Letters Patent is hereby corrected as shown below:

The title page should be deleted to appear as per attached title page.

The sheets of drawings consisting of figures 1-15 should be deleted to appear as per attached figs. 1-15.

Column 2,
Line 8, after "BACKGROUND OF THE INVENTION" insert:

-- This invention was made with Government support under DAAD17-00-C-0034 awarded by U.S. Army. The Government has certain rights in the invention. --

Signed and Sealed this

Second Day of September, 2003

JAMES E. ROGAN
*Director of the United States Patent and Trademark Office*

(12) United States Patent
Koslover

(10) Patent No.: US 6,559,807 B2
(45) Date of Patent: May 6, 2003

(54) COMPACT, LIGHTWEIGHT, STEERABLE, HIGH-POWER MICROWAVE ANTENNA

(75) Inventor: Robert A. Koslover, Tustin, CA (US)

(73) Assignee: Scientific Applications & Research Associates, Inc., Huntington Beach, CA (US)

( * ) Notice: Subject to any disclaimer, the term of this patent is extended or adjusted under 35 U.S.C. 154(b) by 24 days.

(21) Appl. No.: 09/915,800

(22) Filed: Jul. 26, 2001

(65) Prior Publication Data

US 2002/0011963 A1 Jan. 31, 2002

Related U.S. Application Data

(60) Provisional application No. 60/220,930, filed on Jul. 26, 2000.

(51) Int. Cl.[7] ..... H01Q 13/00

(52) U.S. Cl. ..... 343/781 P; 343/713; 343/781 R

(58) Field of Search ..... 343/713, 772, 343/776, 779, 786, 781 P, 781 R, 915

(56) References Cited

U.S. PATENT DOCUMENTS 5,455,589 A * 10/1995 Huguenin et al. ..... 342/175
5,489,818 A * 2/1996 Naff et al. ..... 315/39
5,579,021 A * 11/1996 Lee ..... 343/779
6,014,108 A * 1/2000 Lynch et al. ..... 343/753
6,343,534 B1 * 2/2002 Khanna et al. ..... 102/402

* cited by examiner

*Primary Examiner*—Don Wong
*Assistant Examiner*—Shih-Chao Chen
(74) *Attorney, Agent, or Firm*—John J. Murphey

(57) ABSTRACT

A compact, lightweight, steerable, high-power, microwave weapon including a self-powered, steerable vehicle having at least one exterior antenna support surface, a self-powered, microwave radiation source mounted in the vehicle and including a waveguide to connect the power source to the exterior surface, a feed horn, extending from the waveguide means, including a window transparent to microwave energy for receiving and radiating a pulsed, high-energy microwave radiation beam, a transreflector fixedly mounted on the exterior surface arranged spaced-apart and above the feed horn and having a concave surface facing the feed horn window and formed of a plurality of electrical conductors held in parallel order in a frame, and a twistreflector pivotally mounted opposite and spaced-apart from the concave surface of the transreflector and adapted to receive microwave energy reflected to it from the concave surface of the transreflector and to rotate the polarization by 90° and reflect the microwave energy back to the transreflector for passing through the transreflector and forming a narrow, pencil-like beam of high-energy radiation in polarized form extending outward from the convex surface of the transreflector.

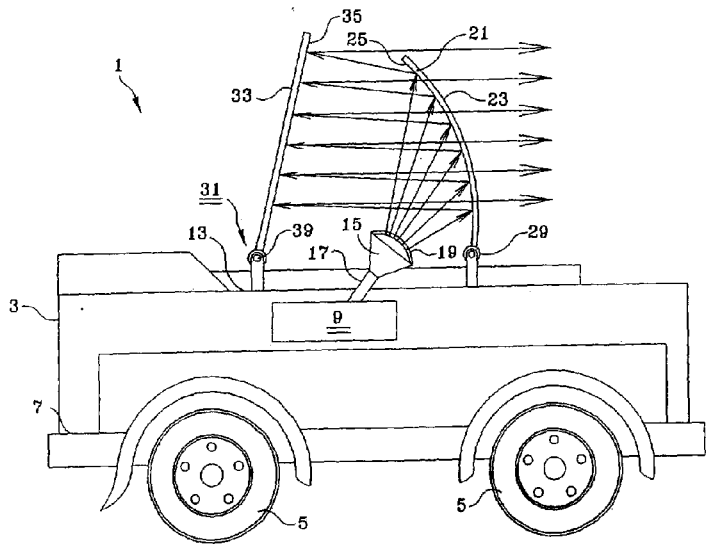

20 Claims, 15 Drawing Sheets